US007597368B2

(12) United States Patent
Savant et al.

(10) Patent No.: US 7,597,368 B2
(45) Date of Patent: Oct. 6, 2009

(54) DOOR HANDLE WHICH IS INTENDED, IN PARTICULAR, FOR A MOTOR VEHICLE COMPRISING AN INERTIAL SAFETY SYSTEM

(75) Inventors: Fiorenzo Savant, Créteil Cedex (FR); Raphaël De Bourayne, Créteil Cedex (FR)

(73) Assignee: Valeo Sicurezza Abitacolo S.p.A., Turin (IT)

( * ) Notice: Subject to any disclaimer, the term of this patent is extended or adjusted under 35 U.S.C. 154(b) by 331 days.

(21) Appl. No.: 11/631,692

(22) PCT Filed: Jul. 4, 2005

(86) PCT No.: PCT/EP2005/053174

§ 371 (c)(1),
(2), (4) Date: Jan. 5, 2007

(87) PCT Pub. No.: WO2006/003197

PCT Pub. Date: Jan. 12, 2006

(65) Prior Publication Data

US 2008/0036219 A1 Feb. 14, 2008

(30) Foreign Application Priority Data

Jul. 7, 2004 (IT) ..... RM2004A0337

(51) Int. Cl.
*E05B 3/00* (2006.01)

(52) U.S. Cl. ..... 292/336.3; 292/DIG. 22

(58) Field of Classification Search ..... 292/336.3, 292/347, DIG. 22
See application file for complete search history.

(56) References Cited

U.S. PATENT DOCUMENTS

| | | | | |
|---|---|---|---|---|
| 3,799,596 | A * | 3/1974 | Nozomu et al. | 292/216 |
| 5,697,655 | A * | 12/1997 | Strong | 292/230 |
| 6,042,159 | A | 3/2000 | Spitzley et al. | |
| 6,880,867 | B2 * | 4/2005 | Schoen et al. | 292/216 |
| 7,070,216 | B2 * | 7/2006 | von zur Muehlen | 292/336.3 |
| 7,156,427 | B2 * | 1/2007 | Kulajew | 292/92 |
| 2002/0059693 | A1 | 5/2002 | Jooss et al. | |

FOREIGN PATENT DOCUMENTS

| | | |
|---|---|---|
| EP | 1 371 799 | 12/2003 |
| WO | WO-2004/042177 | 5/2004 |

OTHER PUBLICATIONS

International Search Report for PCT/EP2005/053174 mailed Oct. 4, 2005 (2 pages).

* cited by examiner

*Primary Examiner*—Gary Estremsky
(74) *Attorney, Agent, or Firm*—Osha • Liang LLP

(57) ABSTRACT

The invention relates to a door handle which is intended, in particular, for a motor vehicle. The inventive handle comprises a lever (105) which can rotate around a first axis (107) in a frame (101) that is intended to be fixed to the door (102) and which is mechanically connected to a mobile fitting that can be intercepted by a locking element which is articulated to the frame (101) or a body which is solidly connected to the frame, such as to pivot around a third axis (117) from a rest position to an active position. In this way, if pivoted violently, the locking member (116) strikes the aforementioned mobile fitting and prevents same from moving. According to the invention, the handle also comprises a piece (200) for blocking the locking element in the active position thereof.

5 Claims, 2 Drawing Sheets

[Fig. 001]
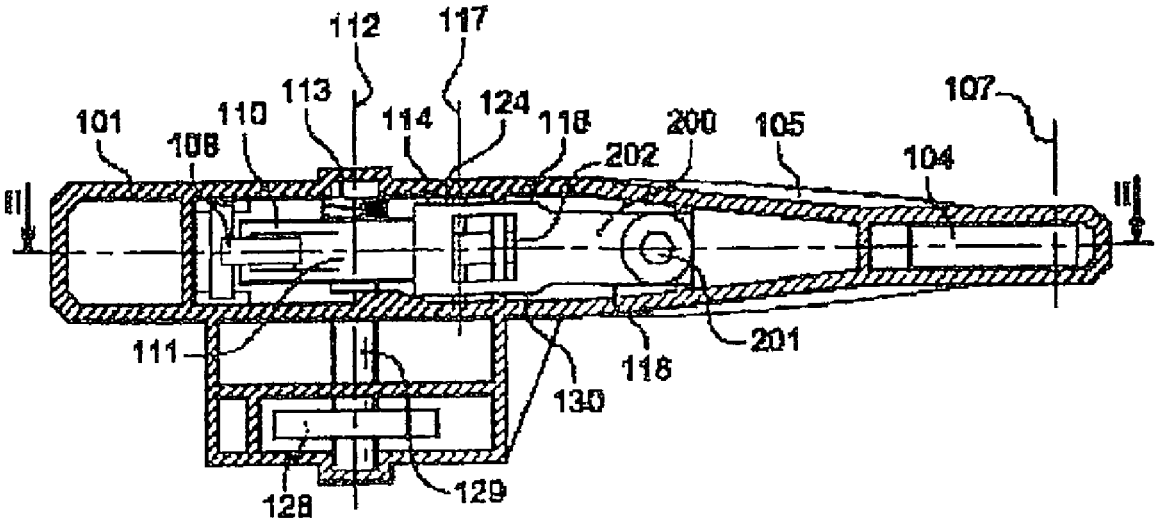
[Fig. 002]
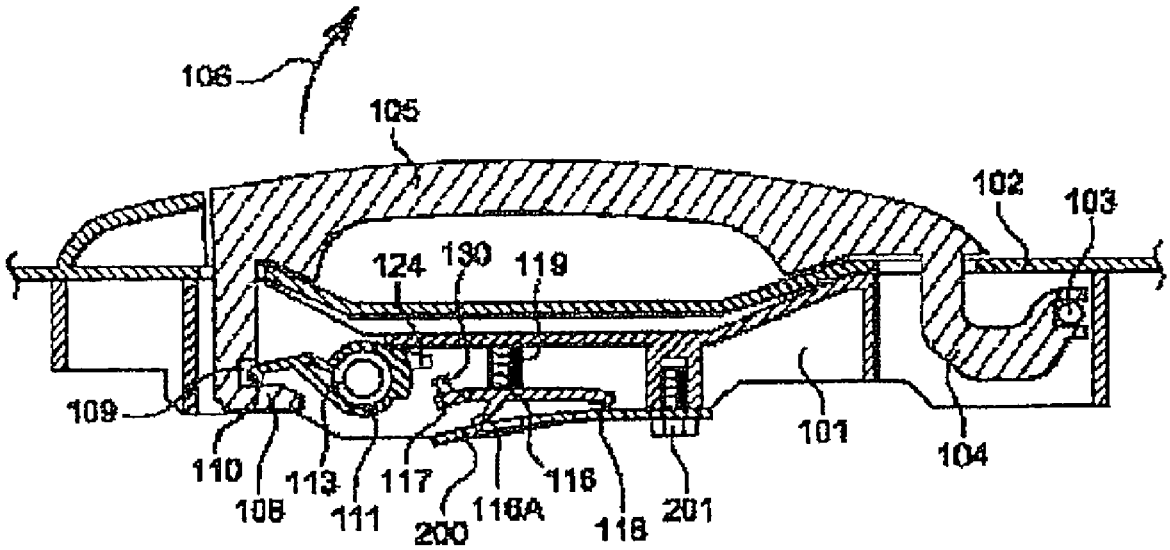

[Fig. 003]
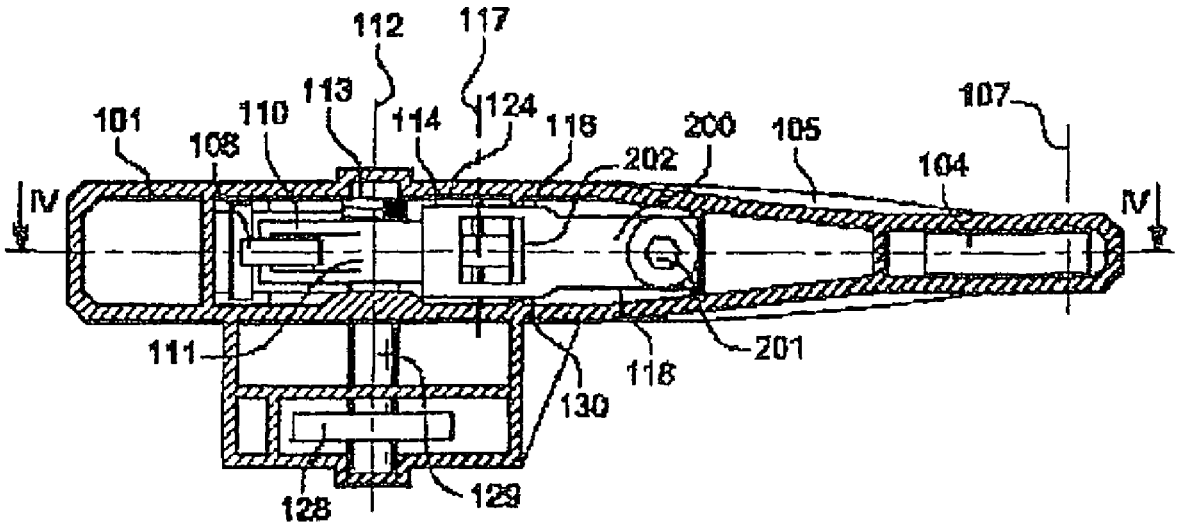
[Fig. 004]
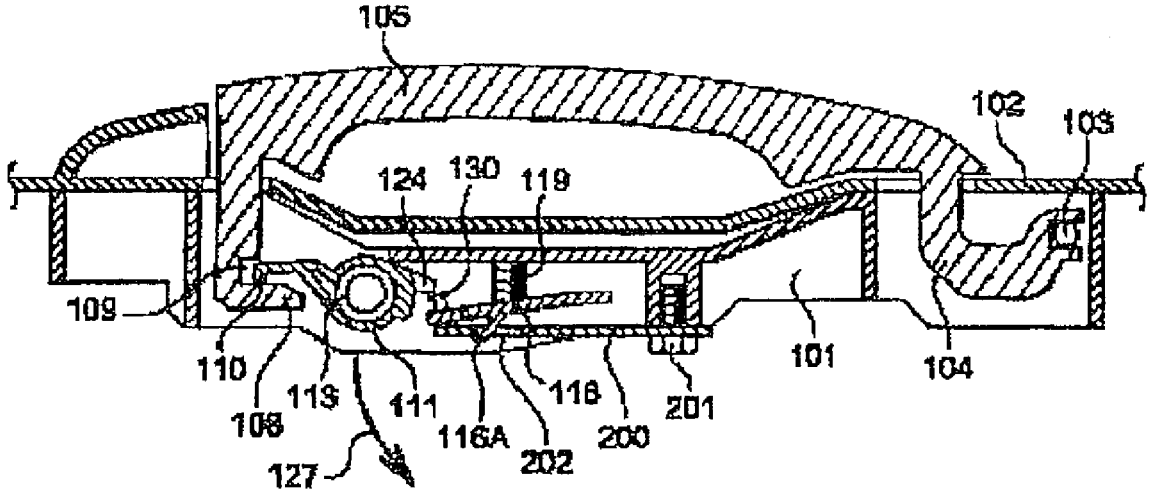

DOOR HANDLE WHICH IS INTENDED, IN PARTICULAR, FOR A MOTOR VEHICLE COMPRISING AN INERTIAL SAFETY SYSTEM

The invention relates to a door handle, in particular for a motor vehicle, with an inertial safety system.

Such a safety system is intended to prevent opening of the door in the event of an accident or a violent impact suffered by the door.

Such a handle is described in the patent document WO2004/042177.

This handle comprises a handle lever which can rotate about a first axis in a frame intended to be fixed to the door and is connected mechanically to a swivel wheel which can rotate inside said frame about a second axis when the lever is pulled so as to open the door. The swivel wheel has a shoulder which is able to be intercepted by a stop piece forming part of a locking element comprising a lever of the rocker arm type which is provided with an inertial mass and is hinged to the frame or with a body fastened to the frame so as to pivot about a third axis such that, during sudden pivoting of the rocker arm, the stop piece strikes the shoulder and prevents rotation of the swivel wheel. This third axis of rotation of the rocker arm is substantially parallel to the first axis of rotation of the handle lever and the inertial mass is arranged between these two axes of rotation.

Although such an arrangement produces a relatively satisfactory result, it is nevertheless the case that it gives rise to the following technical problems.

In the event of a violent lateral impact against the door, it appears that the stresses suffered by the handle support frame are of a very varied nature. Moreover, the constitution of the bodywork of the vehicle plays an important part. For example, the hinging zone of the handle lever, which corresponds substantially to the middle of the door, is a location where there is little rigidity. However, the other end of the handle lever is in the vicinity of a reinforced and rigid structure of the vehicle. Moreover, vibrations of the door panel are produced as a result and this affects the handle and therefore the rocker arm.

The rocker arm may therefore be subject to a more rapid displacement than the other parts. It may therefore return into its rest position as a result of a reverse stress, before interception and locking of the shoulder of the swivel wheel at the start of rotation of the latter pulled by the lever. Its safety function is therefore not fulfilled.

Furthermore, during such lateral impacts, if displacement of the element suffering the collision is blocked after the impact, separation occurs between this element and the vehicle which continues to move carried along by its inertia. If this element therefore engages with the handle lever with a considerable force greater than the force exerted by the rocker arm, the handle lever is therefore pulled and the door may be opened.

In order to solve these problems, the invention proposes a door handle, in particular for a motor vehicle, comprising a lever which can rotate about a first axis in a frame intended to be fixed to the door and is connected mechanically to a mobile fitting able to be intercepted by a locking element hinged to the frame or to a body fastened to the frame so as to pivot about a third axis from a rest position into an active position, in such a way that, during sudden pivoting of this locking element, it strikes said fitting and prevents its displacement, characterized in that said handle also comprises a part for blocking said locking element in its active position.

According to a preferred embodiment, said mobile fitting is a swivel wheel which can rotate inside said frame about a second axis when the lever is pulled so as to open the door, said swivel wheel having a shoulder able to be intercepted by a stop piece forming part of said locking element comprising a lever of the rocker arm type which is provided with an inertial mass, the stop piece striking the shoulder and preventing rotation of the swivel wheel during sudden pivoting of the rocker arm.

Preferably, said rocker arm has a lug on its side opposite to that carrying said stop piece, this lug engaging with said blocking part, in the active position.

Preferably, said blocking part consists of a resilient blade fastened to the frame and having an opening for engagement of said lug, in the active position.

Advantageously, said blocking blade is calibrated so as to be prestressed against said lug in the rest position.

The invention is described hereinbelow in greater detail with the aid of figures which show only a preferred embodiment thereof.

FIG. 1 is a view, from below, of a handle according to the invention in the rest position and during normal use.

FIG. 2 is a laterally sectioned view of a handle according to the invention in the rest position and during normal use.

FIG. 3 is a view, from below, of a handle according to the invention in the blocked position.

FIG. 4 is a laterally sectioned view of a handle according to the invention in the blocked position.

As shown in FIGS. 1 and 2, the handle has a frame 101 which may be fixed behind the outer side of a door 102 of a motor vehicle. The frame 101 has a hinge pin 103 about which an extended part 104 of a lever 105 may be rotated. The lever 105 may be pulled outwards in the direction of the arrow 106 and rotate about a first axis 107 which is substantially parallel to the axis of rotation of the door 102. The lever 105 has an end part 108 which comprises a recess 109 inside which a tongue 110 of a swivel wheel 111 is rotationally engaged.

When the lever 105 is pulled, the swivel wheel 111 rotates inside the frame 101 about a second axis 112 which is substantially parallel to the first axis 107. A helical spring 113 is arranged coaxially with the swivel wheel 111 so as to bring the latter back into its original position, with the lever 105, when the latter is not pulled any longer. The swivel wheel 111 actuates the mechanism of the door 102 by means of a cable which is not shown in the figures and which is pulled by a pulley 128. The latter is connected to the swivel wheel 111 by a shaft 129 so as to rotate with it about the second axis 112.

The handle also has a rocker arm 116 hinged to the frame 101 or a part fastened to this frame. This rocker arm 116 pivots about a third axis 117 substantially parallel to the first axis 107 about which the handle lever 105 rotates. The end of the rocker arm 116 situated between this third axis 117 and the first axis 107 is provided with an inertial mass 118 which has a flat form and is arranged close to the centre of the frame 101 so that the inertial mass 118 is substantially parallel to these axes, while a straight line passing through the centers of gravity of the inertial mass 118 and the lever 105 is substantially perpendicular to the latter.

Resilient means 119, in particular a helical spring arranged between the rocker arm 116 and the frame 101, presses the rocker arm 116 against a stop fastened to the frame 101, in the rest position. This stop, not shown in detail, may consist of a stud formed on the frame 101 and retaining the rocker arm against the pushing force of the spring 119. This helical spring may be replaced by a torsion spring arranged along the third axis 117. The swivel wheel 111 has a shoulder 124 extending towards the stop piece 130 which projects from the rocker arm 116. During normal opening of the handle lever 105, the wheel 111 is rotationally driven and the shoulder 124 passes close to the stop piece 130 without touching it, the rocker arm 116 being immobile in the rest position, but strikes it, preventing rotation of the swivel wheel 111, when there is sudden pivoting on the rocker arm.

As shown in FIGS. 3 and 4, it can be stated that in the event of an accident, if the handle lever 105 undergoes a force that would tend to open it in the direction of the arrow 106, the inertial mass 118 will likewise be subject to the same force, so that the rocker arm 116 will pivot, overcoming the force of the spring 119, which causes the stop piece 130 to be displaced towards the swivel wheel 111. The stop piece 130 of the rocker arm 116, in its new position illustrated by FIGS. 3 and 4, intercepts and locks the shoulder 124 at the start of rotation of the swivel wheel 111 pulled by the lever 105, which will prevent it from rotating and therefore will prevent opening of the door.

According to the invention, the handle also comprises a part for blocking the rocker arm 116 in its active position shown in FIGS. 3 and 4.

The rocker arm 116 has a lug 116A on its side opposite to that carrying said stop piece 130, this lug engaging with the blocking part, in the active position.

This blocking part consists of a resilient blade 200 fastened to the frame 101 at one of its ends, for example screwed by means of a screw 201 onto a reinforcing wall of the frame 101. This blade 200 has an opening 202 for engagement of the lug 116A, in the active position. The blade is calibrated and designed to be prestressed so as to press against this lug in the rest position, as illustrated by FIG. 2.

In the rest position of the rocker arm 116 as shown in FIGS. 1 and 2, during normal opening of the handle lever 105 by means of pulling in the direction of the arrow 106, the wheel 111 is rotationally driven and the shoulder 124 passes close to the stop piece 130 without touching it. The blocking blade 200 is thus prestressed against the lug 116A which bears against this blade in the vicinity of the engaging opening 202.

In the event of an accident, during a violent lateral impact, as mentioned above and as is illustrated by FIGS. 3 and 4, the rocker arm 116 pivots, overcoming the force of the spring 119, and the stop piece 130 of the rocker arm 116 intercepts and locks the shoulder 124. At the same time, through rotation of the rocker arm, the lug 116A slides on the blade in the direction of the engaging opening 202 and engages inside the latter. In this position illustrated precisely by FIG. 4, owing to its form, the rocker arm 116 is blocked and cannot continue to swivel or return to the rest position. The stop piece 130 of the rocker arm 116 therefore definitively locks the shoulder 124 and the wheel 111 effectively preventing any displacement of the handle lever 105 and any opening of the door.

The present invention has been described with regard to an embodiment in which the resilient blade 200 is a mounted part kept fastened to the frame 101, but this resilient blade 200 may also be made integrally with the frame 101 or also form part of a lever which the handle has or even form part of the inertial mass itself.

The invention is described above in a specific embodiment, but it goes without saying that it is applicable to handles having a safety system of a different type, the general principle of the invention being the blocking of the locking element in its active position.

The invention claimed is:

1. A door handle for a motor vehicle, comprising:

a lever configured to rotate about a first axis in a frame intended to be fixed to the door and is connected mechanically to a mobile fitting able to be intercepted by a locking element hinged to the frame or to a body fastened to the frame, wherein the locking element pivots about a third axis from a rest position into an active position, in such a way that, during sudden pivoting of the locking element, the locking element strikes said mobile fitting and prevents its displacement, wherein said door handle also comprises a part for blocking said locking element in its active position.

2. The door handle as claimed in claim 1, wherein said mobile fitting is a swivel wheel which can rotate inside said frame about a second axis when the lever is pulled so as to open the door, said swivel wheel having a shoulder able to be intercepted by a stop piece forming part of said locking element comprising a lever of the rocker arm type which is provided with an inertial mass, the stop piece striking the shoulder and preventing rotation of the swivel wheel during sudden pivoting of the rocker arm.

3. The handle as claimed in claim 2, wherein said rocker arm has a lug on its side opposite to that carrying said stop piece, this lug engaging with said blocking part, in the active position.

4. The handle as claimed in claim 3, wherein said blocking part consists of a resilient blade fastened to the frame and having an opening for engagement of said lug, in the active position.

5. The handle as claimed in claim 4, wherein said blocking blade is calibrated to be prestressed so as to press against said lug in the rest position.

* * * * *